US005904374A

United States Patent [19]

Lee

[11] Patent Number: 5,904,374

[45] Date of Patent: May 18, 1999

[54] COVER MEMBER WITH FOLDABLE BOOKMARK FLAP

[76] Inventor: Chun-Yang Lee, P.O. Box 55-846, Taipei, Taiwan

[21] Appl. No.: 08/918,666

[22] Filed: Aug. 28, 1997

[51] Int. Cl.[6] ..... B42D 3/00; B42D 3/04

[52] U.S. Cl. ..... 281/29; 281/19.1; 281/42; 116/238; 116/239; 40/359

[58] Field of Search ..... 281/19.1, 29, 42; 116/234, 235, 238, 239; 40/359

[56] References Cited

U.S. PATENT DOCUMENTS

| | | | |
|---|---|---|---|
| 1,540,777 | 6/1925 | Hellerman | 116/239 |
| 3,169,029 | 2/1965 | Margolis | 281/29 |
| 3,898,951 | 8/1975 | Clare | 116/239 |
| 4,041,892 | 8/1977 | Nichols | 116/239 |
| 4,765,652 | 8/1988 | Troyen | 282/42 |
| 4,813,370 | 3/1989 | Capamaggio | 281/42 |
| 5,140,934 | 8/1992 | Pennelle | 116/234 |
| 5,249,546 | 10/1993 | Pennelle | 281/42 |
| 5,405,473 | 4/1995 | Kuhns | 281/29 |
| 5,515,809 | 5/1996 | Weinberg | 116/239 |

FOREIGN PATENT DOCUMENTS

| | | | |
|---|---|---|---|
| 585130 | 1/1947 | United Kingdom | 281/42 |

*Primary Examiner*—Willmon Fridie, Jr.
*Assistant Examiner*—Toan Le

[57] ABSTRACT

A cover member of a book includes: at least a foldable bookmark flap integrally formed on a longitudinal edge of a book cover or a dust cover of a book, or a foldable flap integrally secured to an upper edge or a bottom edge of the cover, whereby upon folding of the bookmark flap to be inserted between the pages of the book, a bookmark is provided for conveniently marking a reading place in the book and the flap inserted into the pages of the book will also protect the pages from dust contamination or atmospheric oxidation.

12 Claims, 4 Drawing Sheets

COVER MEMBER WITH FOLDABLE BOOKMARK FLAP

BACKGROUND OF THE INVENTION

A conventional loose bookmark may be inserted between pages in a book for reminding the reading location when temporarily closing a book. However, such a loose bookmark may be easily slipped away from the book pages to lose its bookmark function. The loose bookmark may also be easily lost or missing since it is free and movable from place to place.

A conventional attached bookmark such as a slim ribbon or an elongate strip prefixed in a spine may not be lost. However, the bookmark is so slim and will be difficultly picked up from the gutter or the fold portion within pages of the book. It is still inconvenient to use such an attached bookmark.

SUMMARY OF THE INVENTION

The object of the present invention is to provide a cover member of a book including: at least a foldable bookmark flap integrally formed on a longitudinal edge of a book cover or a dust cover of a book, or a foldable flap integrally secured to an upper edge or a bottom edge of the cover, whereby upon folding of the bookmark flap to be inserted between the pages of the book, a bookmark is provided for conveniently marking a reading place in the book and the flap inserted into the pages of the book will also protect the pages from dust contamination or atmospheric oxidation.

DETAILED DESCRIPTION

Figure 1:
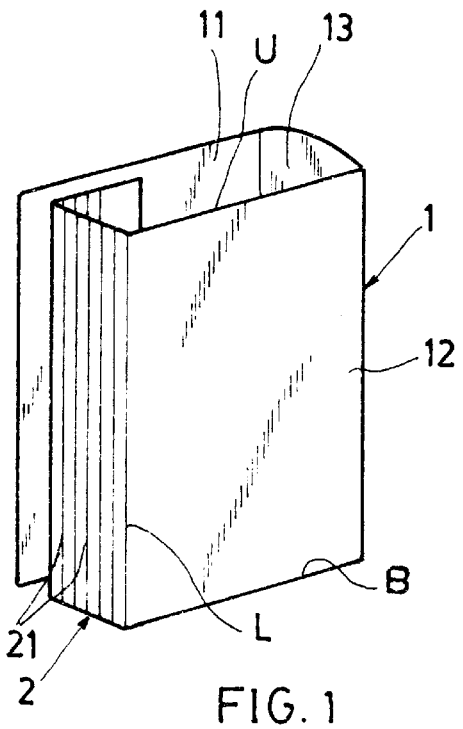
FIG. 1 is a perspective view of the cover member of the present invention.
Figure 2:
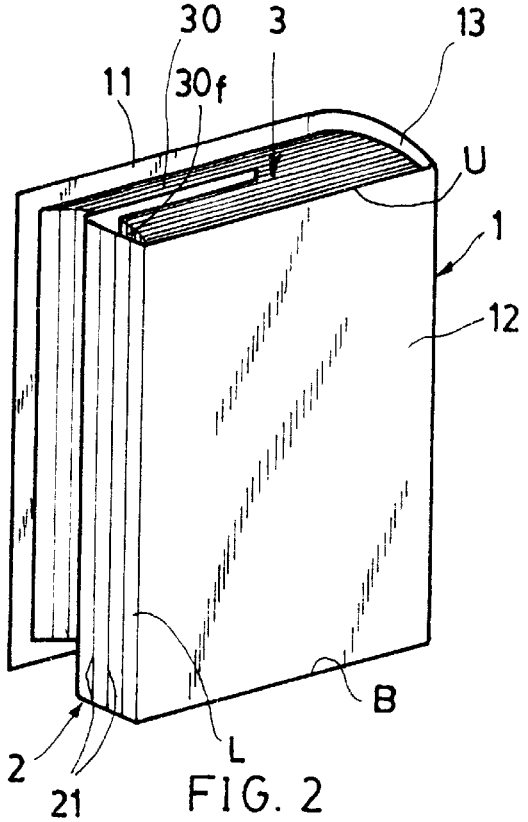
FIG. 2 is an illustration showing a book mark provided by the present invention.

As shown in FIGS. 1 & 2, the present invention comprises: a cover member 1 for covering a book 3 having a front cover 11, a back cover 12 and a spine 13 connected between the front and back covers 11, 12; and a foldable bookmark flap 2 integrally attached to a longitudinal edge L of a back cover 12 (or a front cover 11) of the cover member 1 having a plurality of folding lines 21 juxtapositionally formed on the flap 2 for an easy bending or folding of the flap 2 to be inserted into two neighboring pages 30 of the book 3 through the fore edge **30*f* of each page with each folding line 21 parallel to the longitudinal edge L of the cover member 1 and parallel to a fore edge 30*f* of the page 30 of the book 3**.

The foldable bookmark flap 2 is folded and bent along the folding line 21 to be inserted into the pages 30 of the book 3 as shown in FIG. 2 for a convenient marking purpose. The flap 2 is permanently formed on the cover member 1 and will not be lost or missing to be superior to any conventional bookmark. The flap 2 is also provided for protecting the pages 30 without dust contamination and with less oxidation by the environmental air.

Figure 3:
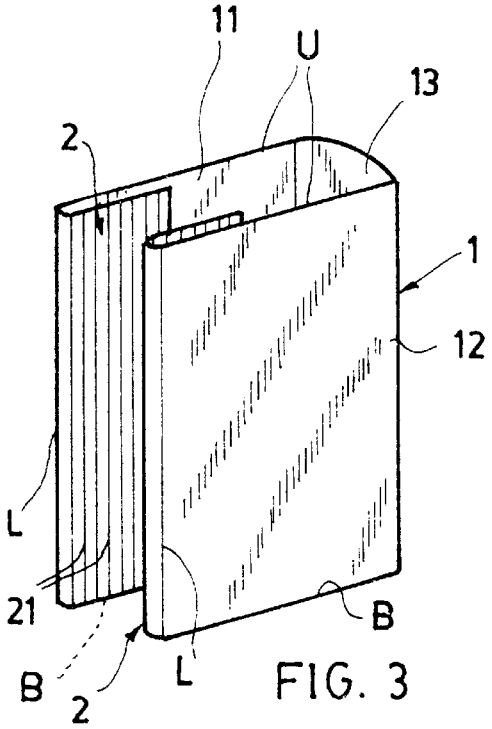
FIG. 3 shows another preferred embodiment of the present invention.

As shown in FIG. 3, a pair of longitudinal foldable bookmark flaps 2, 2 are respectively formed on a front cover 11 and a rear cover 12 of the cover member 1 of the present invention.

Figure 4:
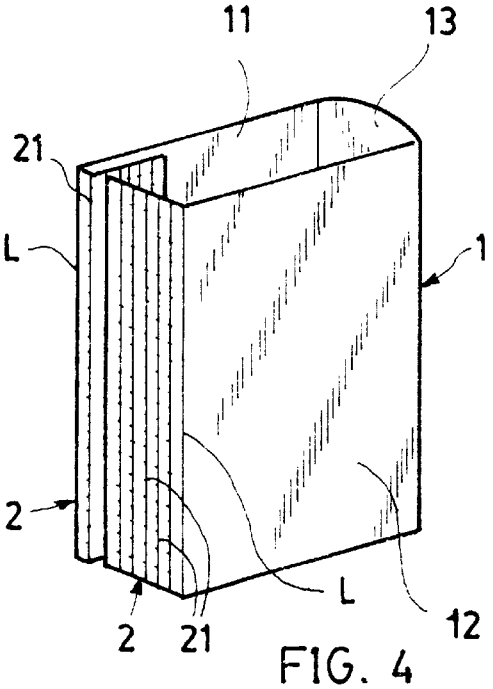
FIG. 4 shows a perforated or slit flap of the present invention.

As shown in FIG. 4, each flap 2 is formed with a plurality of folding lines 21 each folding line 21 having a plurality of perforations or slits longitudinally intermittently formed in the flap 2 along each folding line 21 for an easy folding of the flap. Or, each folding line 21 is slightly recessed in the flap 2 for an easy folding of the flap 2 to be inserted into the pages 30 of the book 3.

Figure 5:
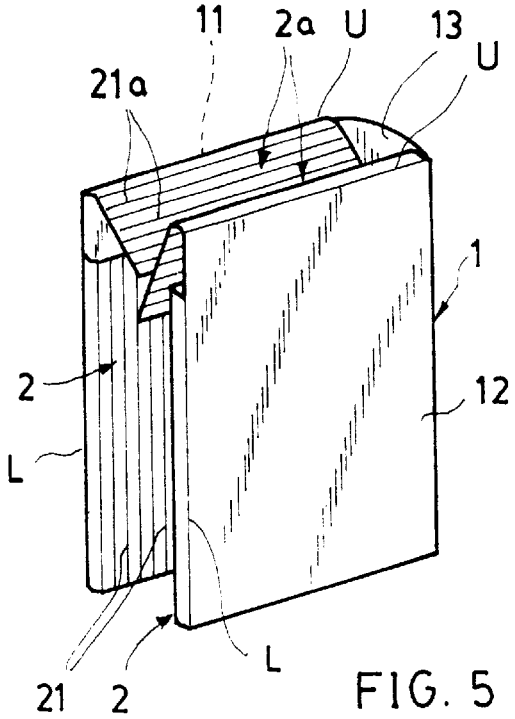
FIG. 5 shows a cover member having a pair of longitudinal foldable bookmark flaps and a pair of upper flaps attached to the cover member of the present invention.
Figure 6:
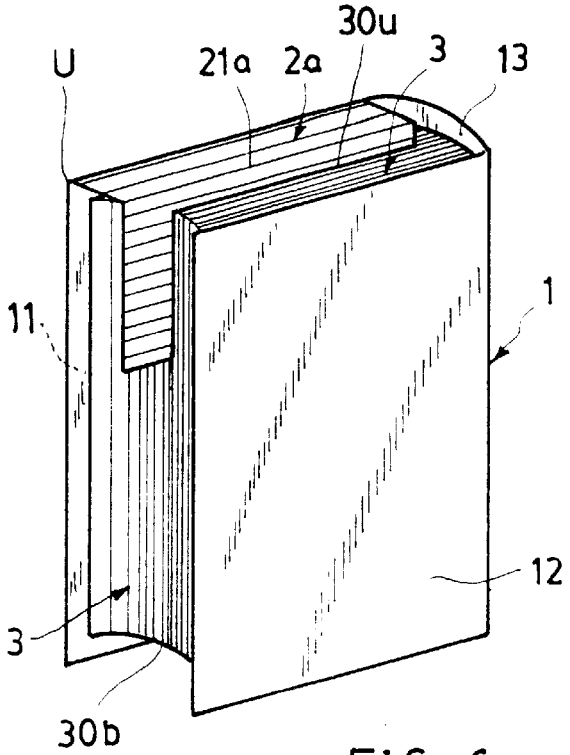
FIG. 6 shows a book provided with the bookmark flap as shown in FIG. 5.

As shown in FIGS. 5 and 6, the cover member 1 includes: a pair of longitudinal foldable bookmark flaps 2 each longitudinally formed on a longitudinal edge L of either a front or back cover of 11, 12 of the cover member each longitudinal flap 2 having a plurality of folding lines 21 longitudinally formed in the flap 2; and a pair of latitudinal foldable bookmark flaps **2*a* each latitudinally formed on an upper edge U of either the front or back cover 11, 12 of the cover member 1 and having a plurality of folding lines 21*a* latitudinally formed in the flap 2*a* each folding line 21*a* parallel to the upper edge U of the cover 11, 12 and parallel to an upper edge 30*u* of the page 30 for an easy folding of the flap 2*a* into the pages 30 of the book 3**.

Figure 7:
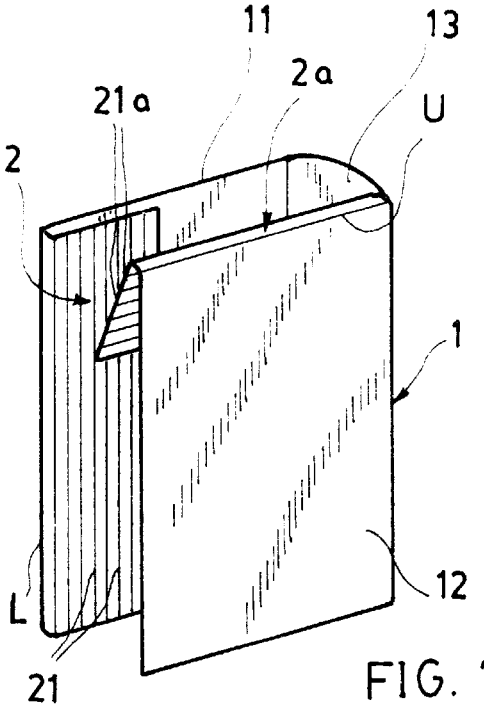
FIG. 7 shows a longitudinal flap and an upper flap respectively secured to a front cover and a rear cover.

In FIG. 7, a longitudinal foldable flap 2 is formed on the front cover 11, while a latitudinal flap **2*a* is formed on the back cover 12** for forming another modification of the present invention.

Figure 8:
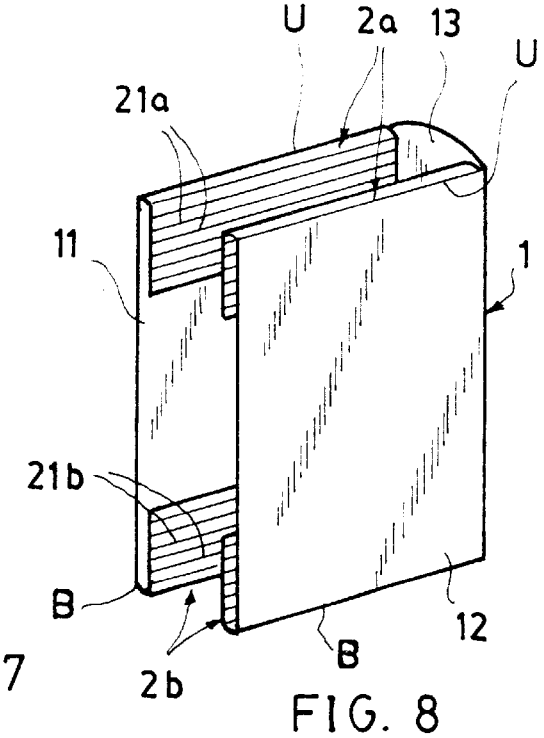
FIG. 8 shows two pairs of upper and bottom flaps attached on the cover member of the present invention.

In FIG. 8, either the front cover 11 or the back cover 12 of the cover member 1 is integrally formed with an upper latitudinal flap **2*a* on an upper edge U of the cover 11 or 12 and a bottom latitudinal flap 2*b* on a bottom edge B of the cover 11 or 12 so that each flap 2*a* or 2*b* may be folded into the pages 30 of the book through the upper (U) or bottom (B) edge of the book page 30**.

Figure 9:
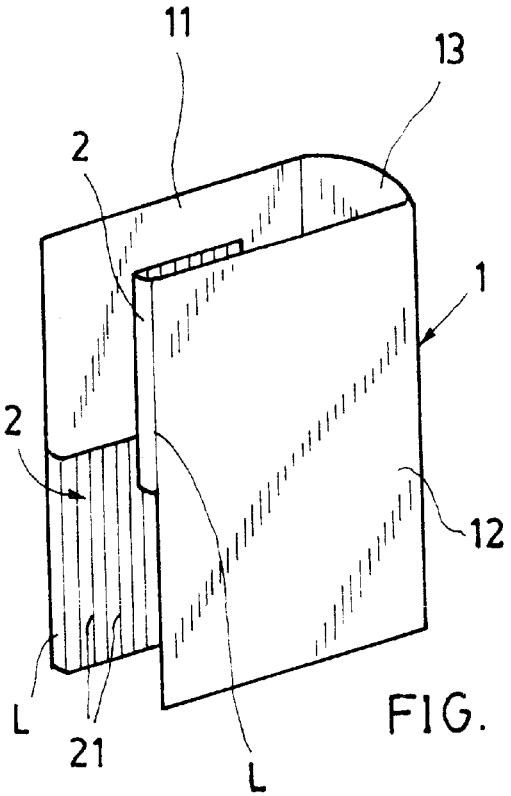
FIG. 9 shows another preferred embodiment of the cover member.

As shown in FIG. 9, each longitudinal foldable bookmark flap 2 is shortened to be about one-half of the height of the longitudinal edge L of either the front cover 11 or the back cover 12.

Figure 10:
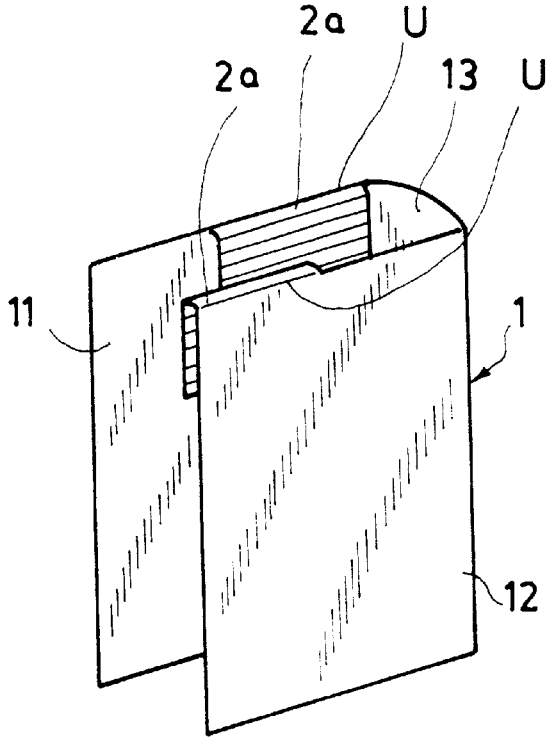
FIG. 10 shows still another preferred embodiment of the cover member.

As shown in FIG. 10, each latitudinal flap **2*a* is also shortened to be about one-half of the width of the upper edge U of either the front cover 11 or the back cover 12**.

Figure 11:
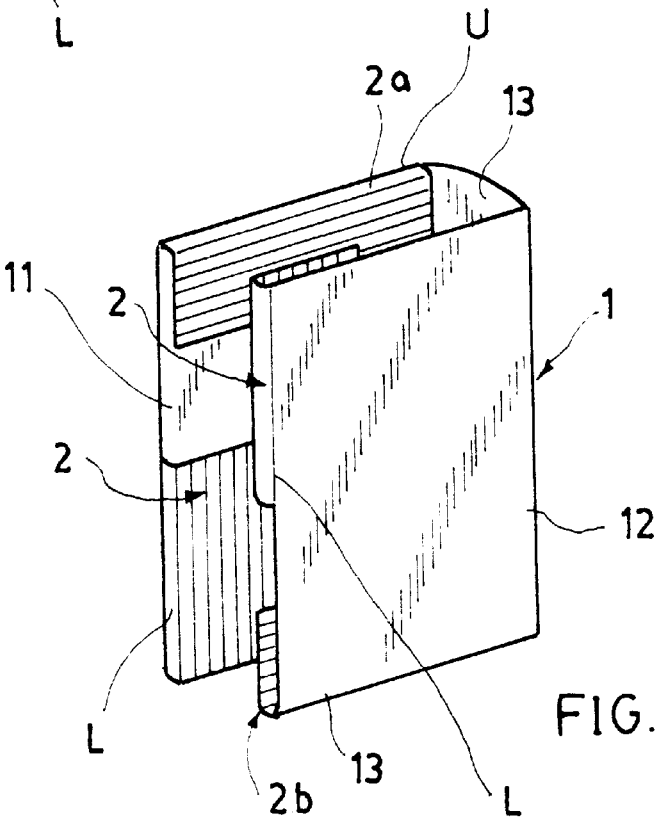
FIG. 11 shows further preferred embodiment of the present invention.

In FIG. 11, the front cover 11 is provided with a shortened longitudinal flap 2 and an upper latitudinal flap **2*a*; while the back cover 12 provided with a shortened longitudinal flap 2 and a lower latitudinal flap 2*b*** for forming further modification of the present invention.

Figure 12:
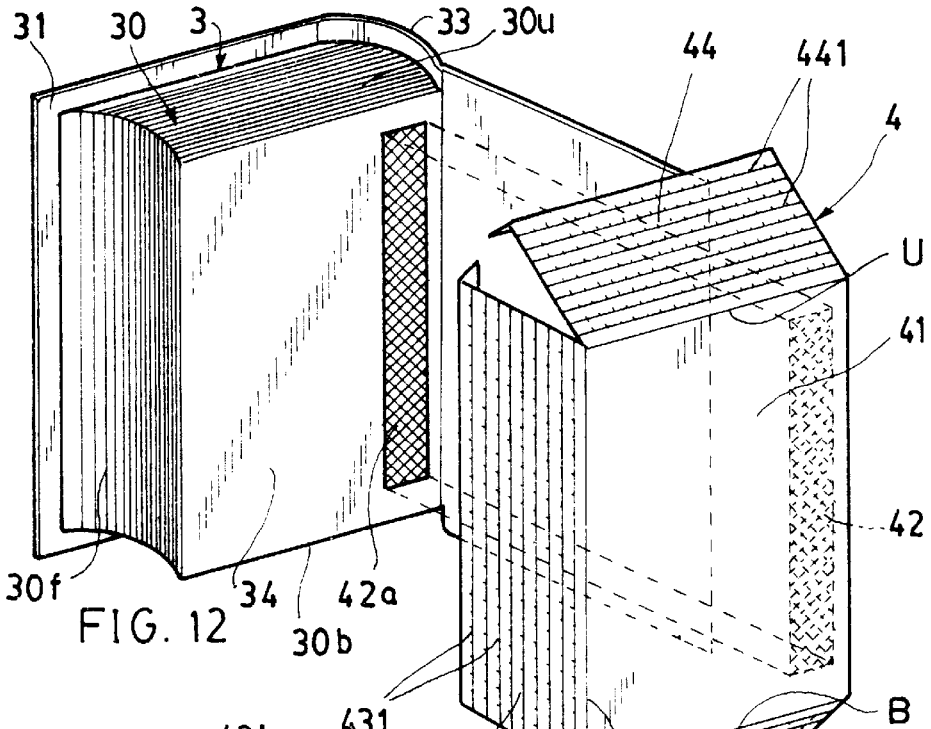
FIG. 12 shows a cover member of this invention detachable to an endpaper of a book.
Figure 13:
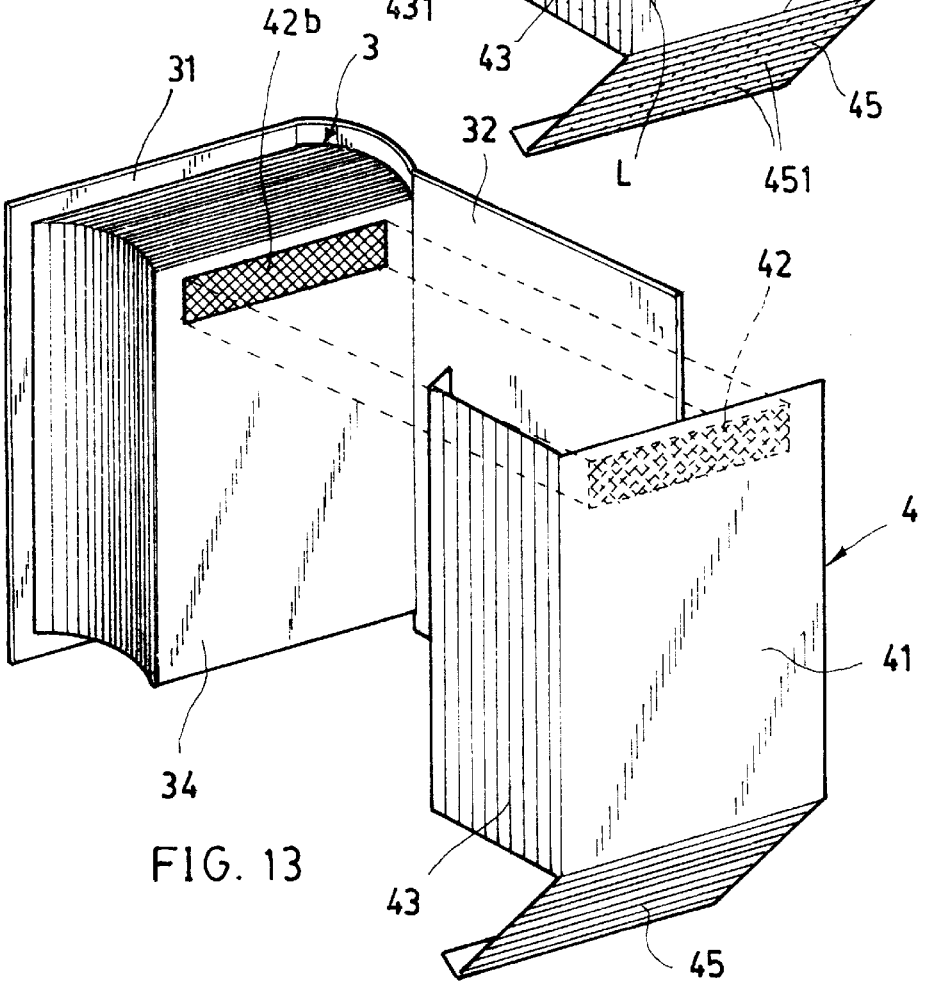
FIG. 13 is a modification from FIG. 12.

As shown in FIGS. 12, 13, a cover member 4 of the present invention includes: a base sheet 41 having a tape 42

(such as a Velcro tape)fixed thereon to be detachably adhered on a tape 42*a* formed on an endpaper 34 of the pages 30 of the book 3 which includes a front cover 31, a back cover 32 secured to the front cover 31 by a spine 33; a longitudinal flap 43 integrally formed on a longitudinal edge L of the base sheet 41 having a plurality of longitudinal folding lines 431 longitudinally juxtapositionally formed on the longitudinal flap 43 for an easy folding of the longitudinal flap 43 into the pages 30 through a fore edge 30*f* of the page 30; an upper latitudinal flap 44 integrally formed on an upper edge U of the base sheet 41 having a plurality of upper folding lines 441 latitudinally juxtapositionally formed on the upper latitudinal flap 44 for an easy folding of the upper latitudinal flap 44 into the pages 30 through an upper edge 30*u* of the page 3; and a lower latitudinal flap 45 integrally formed on a bottom edge B of the base sheet 41 having a plurality of bottom folding lines 451 latitudinally juxtapositionally formed on the bottom latitudinal flap 45 for an easy folding of the bottom latitudinal flap 45 into the pages 30 through a bottom edge 30*b* of the page 30.

The cover member 1 of the present invention may be directly formed as a book cover or may be formed as a dust cover which is further jacketed on a book cover originally existing in a book, not limited in the present invention. The detachable cover member 4 as shown in FIG. 12 may also be adhered on an inner surface of either the back cover 32 or the front cover 31 of the book 3.

The present invention may be modified without departing from the spirit and scope of the present invention.

I claim:

1. A cover member having a front cover, a back cover connected to said front cover by a spine, adapted for covering a book having a plurality of pages formed in the book, comprising: at least a foldable bookmark flap integrally formed on an edge portion of one said cover, and said foldable bookmark flap having a plurality of folding lines juxtapositionally formed in said flap for an easy folding of said flap to be inserted into two neighboring pages of said book.

2. A cover member according to claim 1, wherein each said folding line on said flap includes: a plurality of perforations longitudinally formed in said flap along each said folding line.

3. A cover member according to claim 1, wherein each said folding line includes a plurality of slits intermittently formed in each said folding line.

4. A cover member according to claim 1, wherein each said folding line includes: a groove recessed in said flap along said folding line.

5. A cover member according to claim 1, wherein said foldable bookmark flap is a longitudinal flap integrally formed on a longitudinal edge portion of one said cover selected from said front cover and said back cover of the cover member, with each said folding line longitudinally juxtapositionally formed on said longitudinal flap parallel to a longitudinal edge of said cover and parallel to a fore edge of each page of the book.

6. A cover member according to claim 1, wherein said foldable bookmark flap is a latitudinal flap integrally formed on an upper edge portion of said cover, with each said folding line latitudinally formed on said flap parallel to an upper edge of said cover and parallel to an upper edge of each page of the book.

7. A cover member according to claim 1, wherein said foldable bookmark flap is a latitudinal flap integrally formed on a bottom edge portion of said cover, with each said folding line latitudinally formed on said flap parallel to a bottom edge of said cover and parallel to a bottom edge of each page of the book.

8. A cover member according to claim 1, wherein said foldable bookmark flap has a length smaller than that of an edge portion of said cover.

9. A cover member according to claim 1, wherein said cover member is directly formed as a book cover of said book.

10. A cover member according to claim 1, wherein said cover member is a dust cover for covering the book.

11. A cover member detachably secured to a book comprising: a base sheet detachably adhered on an inside surface of the book which includes a front cover, a back cover secured to the front cover by a spine; a longitudinal flap integrally formed on a longitudinal edge of the base sheet having a plurality of longitudinal folding lines juxtapositionally formed on the longitudinal flap for an easy folding of the longitudinal flap into the pages through a fore edge of the page; an upper latitudinal flap integrally formed on an upper edge of the base sheet having a plurality of upper folding lines latitudinally juxtapositionally formed on the upper latitudinal flap for an easy folding of the upper latitudinal flap into the pages through an upper edge of the page; and a lower latitudinal flap integrally formed on a bottom edge of the base sheet having a plurality of bottom folding lines latitudinally juxtapositionally formed on the bottom latitudinal flap for an easy folding of the bottom latitudinal flap into the pages through a bottom edge of the page.

12. A cover member according to claim 11, wherein said base sheet is adhered on an inside surface of the book; said inside surface selected from: an endpaper surface of the pages, an inner surface of said front cover, and an inner surface of said back cover.

* * * * *